United States Patent [19]

Portalier

[11] 3,980,125

[45] Sept. 14, 1976

[54] APPARATUS FOR MOLDING AT LOW PRESSURE

[75] Inventor: Robert Portalier, Ville d'Avray, France

[73] Assignee: Societe de Vente de l'Aluminium Pechiney, Paris, France

[22] Filed: May 7, 1975

[21] Appl. No.: 575,477

[30] Foreign Application Priority Data

May 10, 1974 France ..... 74.16155

[52] U.S. Cl. ..... 164/154; 164/309; 164/337

[51] Int. Cl.[2] ..... B22D 17/06; B22D 17/32

[58] Field of Search ..... 164/309, 305, 119, 62, 164/337, 154, 155

[56] References Cited

UNITED STATES PATENTS

| | | | |
|---|---|---|---|
| 2,210,544 | 8/1940 | Galloway | 164/62 |
| 2,660,769 | 12/1953 | Bennett | 164/337 X |
| 2,997,756 | 8/1961 | Strom | 164/62 |
| 3,761,218 | 9/1973 | Portaglier | 164/119 UX |

FOREIGN PATENTS OR APPLICATIONS

| | | | |
|---|---|---|---|
| 1,150,182 | 6/1963 | Germany | 164/309 |
| 1,171,295 | 11/1969 | United Kingdom | 164/119 |

*Primary Examiner*—Ronald J. Shore

*Attorney, Agent, or Firm*—McDougall, Hersh & Scott

[57] ABSTRACT

The invention relates to a process and an apparatus for molding metals, alloys and plastics material under low pressure. A gas which is inert with respect to the material to be molded is injected at a controlled rate and in a controlled volume into the compression/expansion chamber of the apparatus during certain phases of the molding operation, while compressed air is used for establishing pressure in the chamber or furnace accommodating the crucible which contains the liquid material to be molded. By virtue of the invention, it is possible to avoid oxidation phenomena and to improve the quality of the moldings.

4 Claims, 6 Drawing Figures

54
24
N
52
40
18

12
16
38
56
2
26
8
6
4

APPARATUS FOR MOLDING AT LOW PRESSURE

The invention relates to a process and apparatus for low pressure molding of metals, alloys and plastics.

So-called "low-pressure" molding processes are known, in which excess gas pressure is applied to the free surface of a molding material in fluid state contained in a crucible accommodated in a fluid-tight chamber, for example in a fluid-tight furnace. The molding material may be a metal, an alloy or a synthetic resin.

The excess pressure established in the fluid-tight chamber causes the liquid material to ascend through a plunger tube which, at its upper end, communicates with a mold formed with gas outlet openings. The plunger tube is fitted, between the crucible and the mold, with a compression-expansion chamber which comprises first and second compartments communicating with one another, the second compartment forming a gas chamber in the phase in which excess pressure is established in the fluid-tight chamber.

After at least partial solidification of the liquid material in the mold, the gas pressures in the fluid-tight chamber and in the second compartment are balanced, after which atmospheric pressure is re-established in these two chambers to enable the non-solidified material to flow back into the crucible.

A molding apparatus for carrying out this process, especially for molding hollow articles, is described in French Pat. No. 71.28,190 filed Aug. 2, 1971 in the name of Pechiney, which application corresponds to U.S. Pat. No. 3,761,218.

In an apparatus of this kind, pressure is established in the fluid-tight chamber by means of compressed air or by means of a gas which is inert with respect to the material to be molded.

However, it has been found that, especially in the casting of metals and alloys by the low-pressure process, there are almost always oxidation phenomena, often considerable, in the liquid metal during the decompression stage which causes the non-solidified metal to flow back through the plunger tube into the crucible.

The reason for these oxidation phenomena is that the separation between the solidified portion and the liquid portion of the metal is never complete, with the result that fractions in pasty form become detached, are oxidized and accumulate at the surface of the liquid in the plunger tube. Each time the mold is filled, there is an accumulation of oxides which enter the molding and can reduce or alter the quality thereof.

Similar phenomena may even occur in cases where the compressed gas used for establishing pressure in the apparatus is an inert gas.

By virtue of the process and the apparatus of this invention, it is possible to avoid the formation of oxides, to eliminate them if they have been accidentally formed and, finally, to facilitate the degassing operations in the apparatus itself which, heretofore, has been impossible.

The process, according to the invention, is distinguished by the fact that excess pressure is established in the aforementioned fluid-tight chamber containing the crucible by means of compressed air, and by the fact that the second compartment of the above-mentioned compression/expansion chamber is selectively fed at a controlled rate and under a controlled pressure with a gas that is inert with respect to the material to be molded.

By virtue of this separation of the functions of the gases, it is possible to avoid the disadvantages attributable to oxidation, this result being obtained solely by using a small, measured volume of compressed inert gas (for example nitrogen or argon) because compressed air is used for the main pressurization of the apparatus.

In one embodiment of the invention, each molding operation is preceded by injection of the inert gas at a low rate into the second compartment. The second compartment filled with inert gas is closed in fluid-tight manner, after which excess pressure is established in the above-mentioned chamber with compressed air. After at least partial solidification, more inert gas is injected into the second compartment and the chamber returned to atmospheric pressure, while a flow of inert gas into the second compartment is maintained while the non-solidified material falls back into the crucible.

In one advantageous embodiment of the invention, on completion of a molding cycle and when all the non-solidified material has drained back into the crucible, the flow of inert gas into the second compartment is temporarily prolonged, the inert gas escaping through the plunger tube and the crucible for removing impurities from the tube and bubbling through the liquid material before escaping at the free surface thereof.

The invention also relates to an apparatus for molding under low pressure, in which the chamber accommodating the crucible may, selectively, either be connected to a compressed air source, or closed in fluid-tight manner or connected to the atmosphere, and in which the second compartment of the compression/expansion chamber comprises, at its upper end, an outlet pipe which may be selectively connected to a source of inert gas under pressure, means for stopping the flow of gas and means for controlling the flow of gas being provided in the outlet pipe.

The invention also relates to an apparatus of the kind described comprising an automatic device for distributing and measuring the compressed air and inert gas, said device comprising an oscillating reservoir in which two chambers of inversely variable volumes contain the compressed air and the inert gas, respectively.

Finally, the invention relates to the application of the new process and the new apparatus to a low-pressure molding installation of the type described in the above-mentioned French patent application.

These and other objects and advantages of the invention will hereinafter appear, and for purposes of illustration, but not of limitation, embodiments of the invention are shown in the accompanying drawings, in which.

Figure 1:
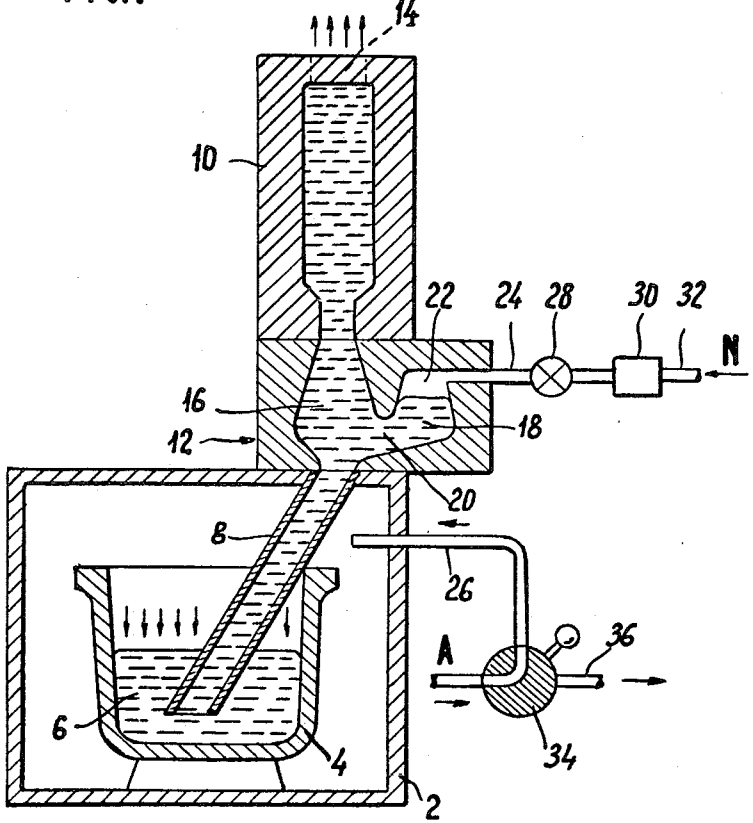
FIG. 1 is a diagrammatic sectional elevational view through a low-pressure casting installation illustrating the process of this invention.

A low-pressure casting installation of the type described in the above-mentioned French patent application is shown by way of example in FIG. 1 in order to illustrate the process of this invention.

Briefly described, the installation comprises a fluid-tight chamber 2, for example a furnace, accommodating a crucible 4 containing the molding material 6, for example a metal or a light weight alloy, in liquid form. A vertical or oblique plunger tube 8 dips into the liquid metal and, at its upper end, communicates with a mold 10, a compression/expansion chamber 12 being arranged between the plunger tube and the mold. At its upper end, the mold 10 comprises a gas vent 14.

The chamber 12 consists of a first compartment 16 and a second compartment 18 which communicate with one another at their lower ends through a passage 20. The second compartment 18, forming a gas chamber which may contain a "cushion" 22 of gas under pressure, is provided at its upper end with an outlet 24.

The chamber 2 is provided with an inlet 26 for the pressurizing medium.

The outlet 24 is fitted with a check valve 28 and a flow-limiting device or flowmeter 30, the other end 32 of the outlet 24 being connected to a source of gas (denoted by the reference N in FIG. 1) which is inert with respect to the material to be molded, for example with respect to an aluminum alloy. The inert gas used may be, for example, nitrogen, argon or any other gas with the same properties which enables a non-oxidizing atmosphere to be established in the upper zone of the liquid metal.

The inlet 26 is fitted with a three-way valve 34 which enables the chamber 2 to be selectively connected to a compressed air source (denoted by the reference A in FIG. 1) or to a manifold 36 opening into the atmosphere, or to be closed in fluid-tight manner.

In the first operational phase of the process, in which the mold has just been closed following removal of the preceding casting, the valve 34 is closed, the chamber 2 is at atmospheric pressure, while the valve 28 is open, the flow-meter 30 supplying a weak flow of inert gas (for example of the order of 1 l/minute) which provides for the low-pressure flushing of the feed system.

In the second phase of the process, the input of inert gas is interrupted by closing the valve 28, and the valve 34 is opened (to the position shown in FIG. 1) to allow compressed air into the mold. The liquid metal is forced to ascend through the plunger tube 8 into the compression/expansion chamber 12 and into the mold 10. The liquid metal compresses a cushion of inert gas 22 in the second compartment 18.

During the complete or partial solidification of the article to be molded (depending on whether solid or hollow articles are to be produced), the valve 34 is closed to maintain the filling pressure.

In the third phase of the process, i.e. when the article to be molded has completely or partly solidified, and just before the chamber 2 is returned to atmospheric pressure, the valve 28 is re-opened to inject a small quantity of inert gas into the compartment 18 until the liquid level in that compartment is such that the inert gas is able to escape into the upper part of the compartment 16. This position of the installation is shown in FIG. 2 which is a view of part of a preferred modification of the invention.

After the valve 34 has been reconnected to the atmosphere, the input of inert gas through the inlet 24 is adjusted to a very low rate during the complete descent of the metal through the tube 8 until atmospheric pressure has been restored, which in the fourth phase of the process enables the molding to be removed while at the same time maintaining an inert atmosphere in the feed system until the next operation.

Figure 3:
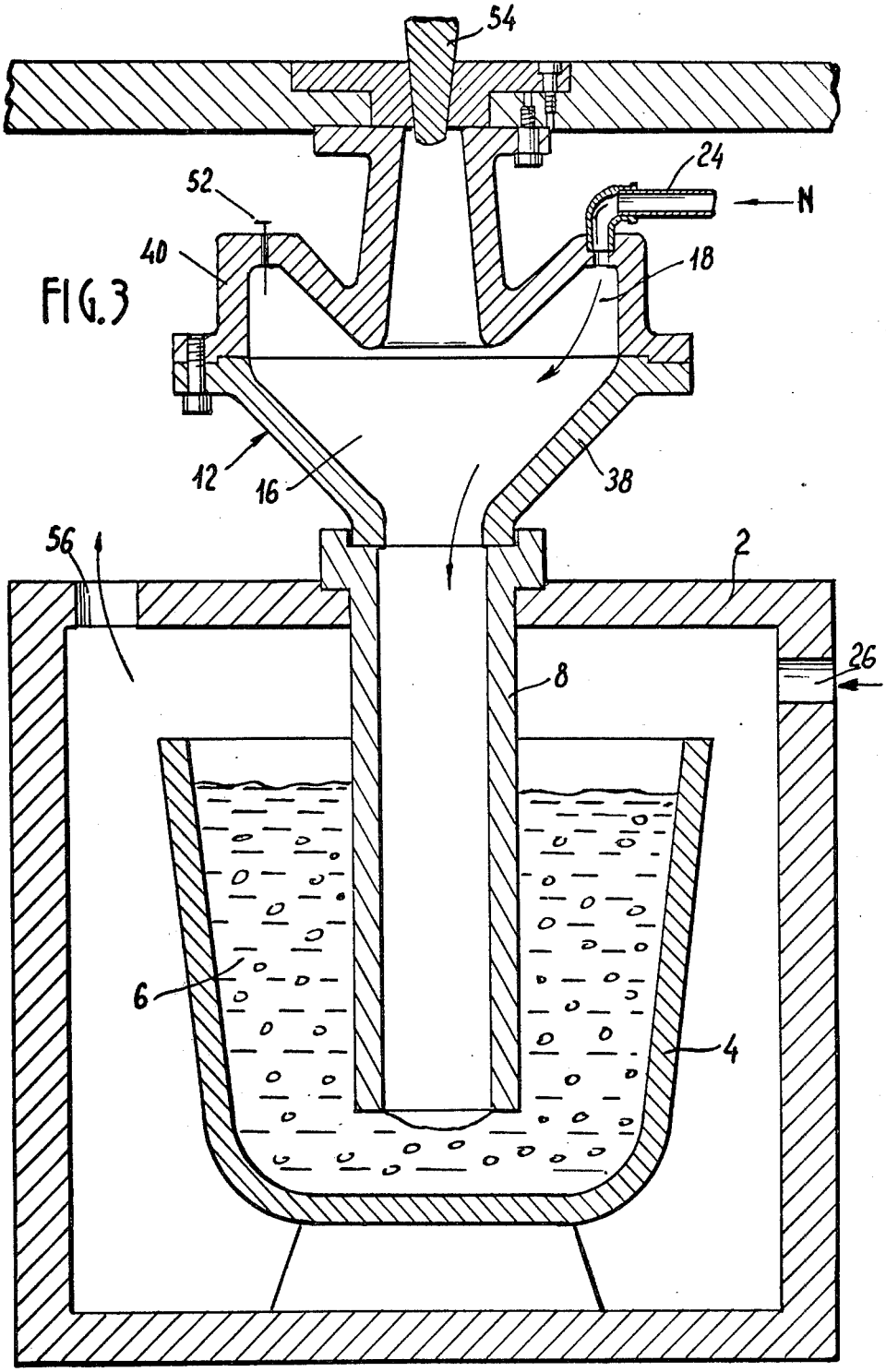
FIG. 3 is a sectional elevational view through the same apparatus but illustrating the deoxidizing and degassing operations.

As can be seen from FIG. 3, the process and apparatus according to the invention may also be used for degassing and deoxidization, and, in particular, for the elimination of any oxides which may have accumulated in the plunger tube.

Figure 2:
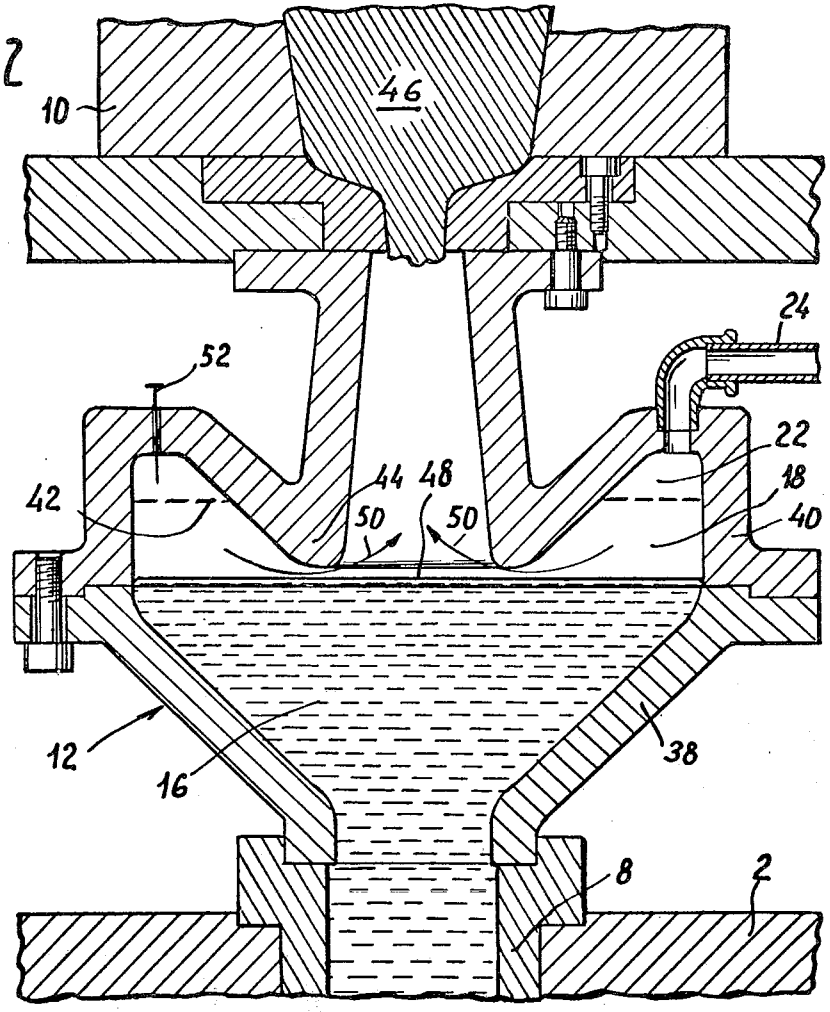
FIG. 2 is a sectional elevational view through part of a preferred embodiment of a casting apparatus embodying the features of this invention.

FIGS. 2 and 3 show a preferred embodiment of the molding apparatus for carrying out the process according to the invention.

The important parts are denoted by the same reference numerals as in FIG. 1. In the modification shown in FIGS. 2 and 3, the plunger tube 8 is vertically disposed rather than oblique, while the compression/expansion chamber 12 has a particular structure.

This chamber is in the form of a body of revolution about the vertical axis and may consist of two, substantially frustoconical sections 38 – 40 contiguous with one another (or of a single molded section) and of such shape that the first compartment 16 of the chamber is situated at the center thereof, while the second compartment 18 has an annular form around the first compartment.

When, during the second phase of the process, the level of the metal, or more generally the level of the material to be molded, in the chamber reaches the level 42 (indicated in broken lines in FIG. 2), corresponding to the level shown in FIG. 1, a certain quantity of inert gas is trapped in the upper fluid-tight portion 22 of the annular volume of the second compartment 18.

When the liquid metal reaches the level 42, the two compartments are separated by the annular partition 44 which dips into the liquid metal.

FIG. 2 is a detailed illustration of the third phase of the process, i.e. the phase where, after the complete or partial solidification of the article 46 to be molded, a small quantity of inert gas is injected through the inlet 24 until the level of liquid 48 in the annular space is such that the inert gas is able to escape (cf. the arrows 50) into the central upper portion of the apparatus.

FIGS. 2 and 3 also show a safety system 52 in the form of two electrodes or contacts which are short circuited when the metal rises above the predetermined level in the compartment 18 (for example in the event of defective sealing of this compartment due to a leak in the inlet 24 or upstream thereof). In such event, the safety system automatically interrupts the pressurization of the chamber 2.

FIG. 3 illustrates, in particular, the possibilities for degassing and deoxidization afforded by an apparatus according to the invention. In cases where it is desired to carry out treatment of this kind, it is sufficient to block the nozzle communicating with the mold by means of a fluid-tight stopper 54 and to place the inert gas, for example nitrogen, introduced through the inlet 24 under excess pressure in order to make it bubble through the liquid bath. The chamber 2 is then connected to the atmosphere through an opening 56 (for example the filling opening) or by suitably positioning the valve 34 shown in FIG. 1. Any oxides which may have accumulated in the tube 8 are displaced towards the surface of the bath so that they can no longer be entrained into the molding during subsequent filling cycles, and the liquid metal undergoes vigorous degassing.

Figure 4:
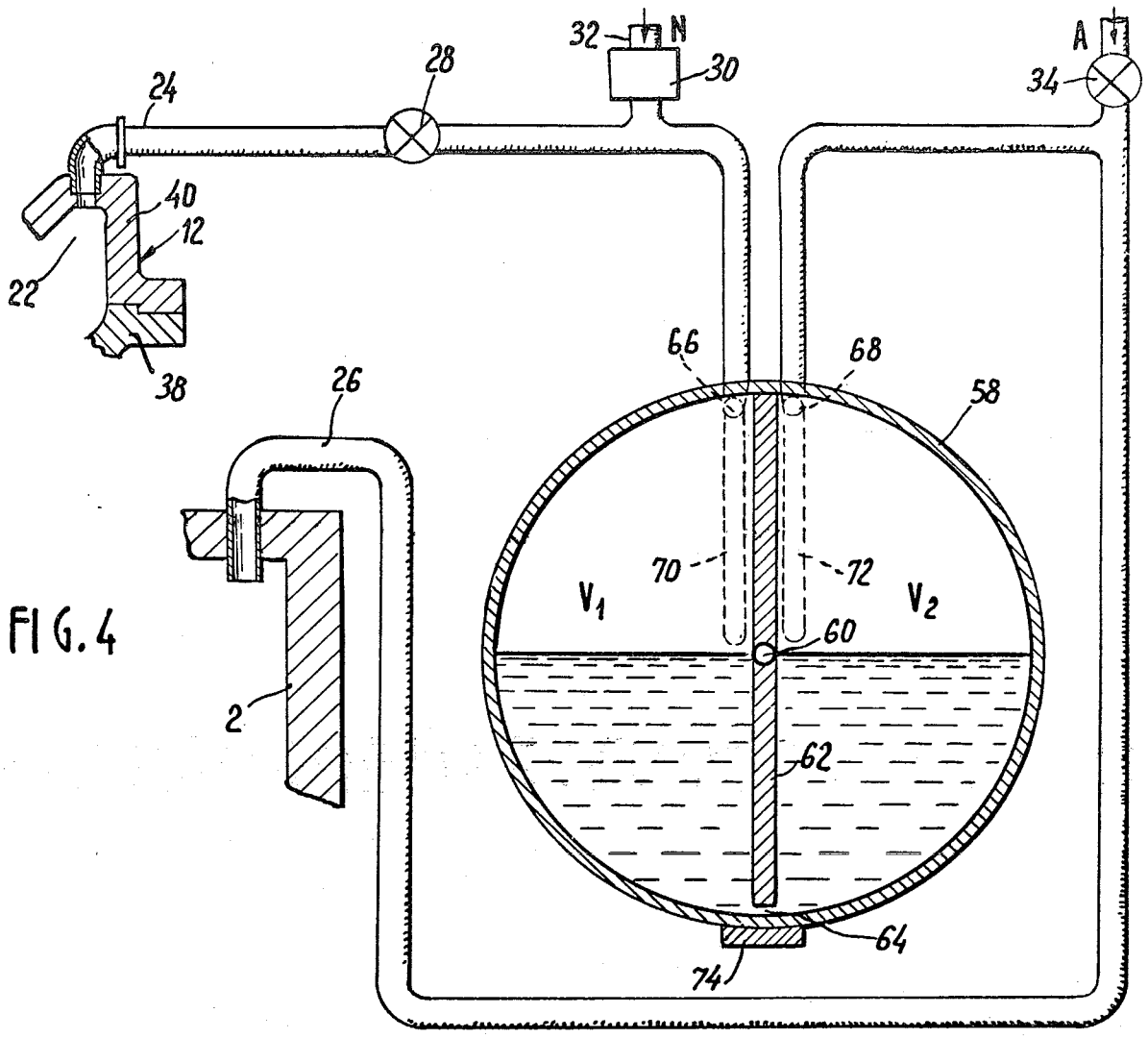
FIG. 4 is a sectional elevational view of an automatic device for the supply of inert gas which may be applied to a low-pressure casting apparatus according to the invention.

FIG. 4 shows a metering device for supplying inert gas to a low-pressure casting apparatus according to the invention. The device is designed to be connected to an apparatus identical with that shown in FIGS. 2 and 3, which is the reason why the chamber 2, where the inlet 26 starts, and the compression/expansion chamber 12, where the outlet 24 starts, have only been partly illustrated.

The feed device comprises a fluid-tight cylinder 58 which oscillates about its horizontal axis 60 and which is internally separated by a diametric partition 62 formed with an opening 64 at its lower end. This cylinder is half-filled with oil or any other non-volatile highly stable liquid which is inert with respect to the gas selected. Two inlets are provided at 66 and 68, opening into the upper portions of the respective volumes $V_1$ and $V_2$. These inlets are connected by highly flexible pipes 70 – 72 to the center of oscillation and a light weight 74 normally urges the cylinder into the position illustrated in FIG. 4.

The outlet 24 opening at the upper end of the compression/expansion chamber 12 is connected to the inlet 66 (communicating with the volume $V_1$) through a flexible pipe which does not interfere with the oscillations of the cylinder about its axis 60.

Between the cylinder 58 and the chamber 12, there are provided a valve 28 and an inlet for inert gas N metered by the flowmeter 30 which also performs the functions of a pressure reducer.

The inlet 68 (communicating with the volume $V_2$) is connected, again through a flexible pipe, to the inlet 26 of the chamber 2 which is itself connected to the compressed air feed A through the valve 34.

In the first phase of the process, which was described above, i.e. when the mold has been closed following removal of the preceding casting, the cylinder 58 is in equilibrium with a vertical partition 62, as shown in FIG. 4. The valve 28 is open, the flowmeter 30 providing for the low-pressure flushing of the feed system (for example of the order of 1 liter per minute) and maintaining the inert gas in $V_1$ at atmospheric pressure. The valve 34 is closed and the chamber 2 is at atmospheric pressure as is the volume $V_2$.

In the second phase it is sufficient to recall that the valve 34 is opened to allow pressure medium into the chamber 2, and that the valve 28 is closed in order to close the upper volume 22 of the second compartment of the chamber 12 in fluid-tight manner.

Figure 5:
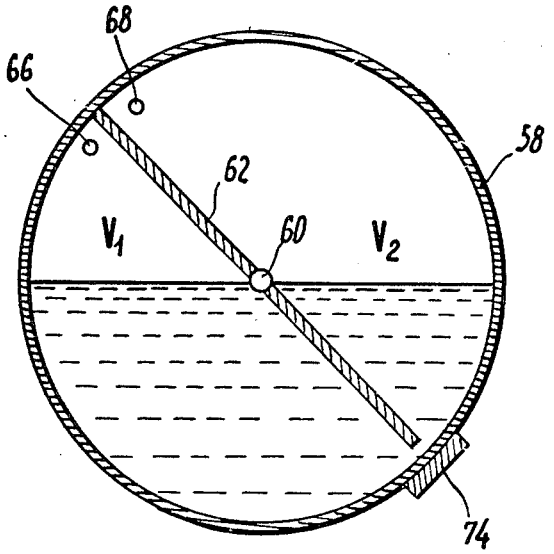
FIGS. 5 and 6 are sectional views illustrating the cylinder used as metering element in the feed device shown in FIG. 4 in two different positions.

The increase in pressure in $V_2$ pushes the liquid in the cylinder towards the left and causes the cylinder to oscillate, thus compressing the gas present in $V_2$ (position shown in FIG. 5).

The flowmeter 28, functioning as a pressure reducer, closes automatically under the effect of the increase in pressure in $V_1$. The equilibrium of the rotation of the cylinder 58 is reached when the mold is full and the pressures in $V_1$ and $V_2$ are substantially equalized due to the fact that the weight 74 is very light and is just sufficient to compensate the friction generated during return to the initial equilibrium.

On completion of the second phase, the molding is left to harden (completely or partly) while the filling pressure is maintained (the valve 34 being closed).

In the third phase, i.e. during return to atmospheric pressure, the valve 28 is opened, so that $V_1$ is decompressed, and the solid part separated from the liquid part in the lower part of the mold, the volume $V_1$ diminishes under the effect of the limited expansion of $V_2$, after which the valve 34 is closed.

Figure 6:
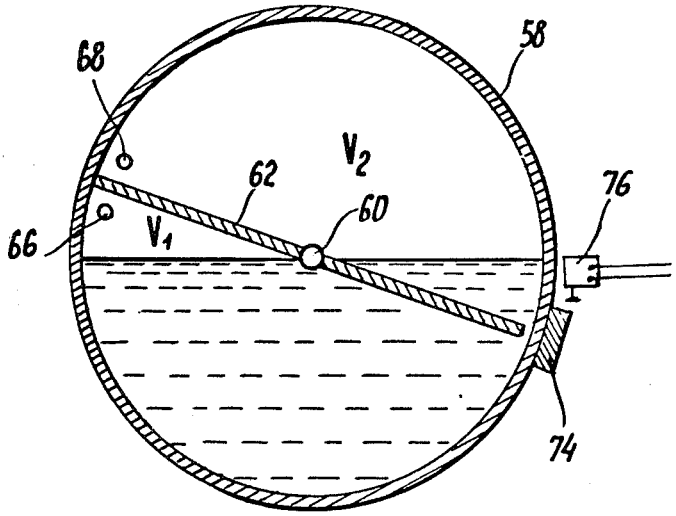

The cylinder assumes the position illustrated in FIG. 6. By virtue of this additional oscillation of the cylinder, a measured quantity of inert gas is automatically injected, as already mentioned in reference to FIG. 2.

All that remains is to reconnect the valve 34 with the atmosphere to decompress the chamber 2, operation of the valve 34 being able to be controlled chronometrically, for example 2 or 3 seconds after opening of the valve 38, or even by an end-of-stroke switch 76 (FIG. 6) on which the cylinder 58 acts on completion of its oscillation.

The separation atmosphere is established and the column of liquid re-descends through the tube.

In the fourth phase, the cylinder 58 returns to its initial equilibrium position shown in FIG. 4, while the flowmeter 30 again provides for low-pressure flushing with inert gas because it is not subjected to any counter pressure. The molding is then removed from the mold which is then closed again in an inert atmosphere and the cycle recommences.

The automatic device, according to the invention, for distributing compressed air and inert gas is very simple in structure, avoids any possibility of leakage between the two zones (air and inert gas) and provides for accurate, constant metering of the inert flushing gases which improves the metallurgical quality of the moldings.

Naturally the invention is by no means confined to the embodiments described and illustrated, and lends itself to numerous modifications according to the applications envisaged which are accessible to the expert and which are included in the scope of the invention, especially as defined in the following claims.

I claim:

1. A low-pressure molding apparatus of the type comprising a mold, a compression/expansion chamber communicating with the lower end of the mold, a fluid-tight chamber, a crucible within the fluid-tight chamber and a plunger tube communicating the compression-/expansion chamber with the crucible, the compression/expansion chamber comprising first and second compartments communicating with one another at their lower ends, the second compartment being provided at its upper end with an outlet which is connected to a source of gas under pressure, this gas being a gas which is inert with respect to the molding material contained in the crucible, a check valve and a device for controlling the rate of flow of the gas being arranged between the outlet and the inert gas source, the fluid-tight chamber being provided with an inlet for medium under pressure which is connected to a compressed air source with a check valve in between, the improvement which comprises a device for automatically feeding and metering inert gas and compressed air arranged in the outlet and in the pressure medium inlet, the automatic feed and metering device comprising a cylinder mounted for free oscillation about a horizontal axis, a diametric partition dividing the cylinder into two compartments and which only communicate with one another through at least one opening formed in the lower part of the partition, a liquid partially filling the cylinder, an outlet in the upper end of the first compartment and a pressure medium inlet communicating with the second compartment at its upper end.

2. An apparatus as claimed in claim 1, comprising a flexible pipe communicating the first compartment with the inlet, said pipe being connected between the check valve and the device for controlling gas flow arranged between the inert gas source and the outlet.

3. An apparatus as claimed in claim 1, wherein the second compartment communicates with the pressure-medium inlet through a flexible pipe connected between the check valve and the pressure-medium inlet.

4. An apparatus as claimed in claim 1, wherein the means are provided for returning the cylinder to an equilibrium position in which the above-mentioned partition is vertical.

* * * * *